United States Patent [19]

LaBounty

[11] Patent Number: 4,955,972

[45] Date of Patent: Sep. 11, 1990

[54] CATCH BASIN FOR BRIDGE DECK DEMOLITION

[76] Inventor: Roy E. LaBounty, HC2, Box 105E, Two Harbors, Minn. 55616

[21] Appl. No.: 270,213

[22] Filed: Nov. 14, 1988

[51] Int. Cl.[5] ..... B65D 19/02; B66C 1/26

[52] U.S. Cl. ..... 294/68.26; 294/67.2

[58] Field of Search ..... 294/67.2, 67.21, 67.5, 294/68.1, 68.2, 68.21, 68.26, 68.27, 63.1, 67.1, 67.22, 68.22; 52/122.1, 127.1; 414/403, 419–425

[56] References Cited

U.S. PATENT DOCUMENTS

| | | | |
|---|---|---|---|
| 555,080 | 2/1896 | Delaney | 294/68.26 X |
| 1,695,960 | 12/1928 | Hackworth | 294/67.2 |
| 1,804,266 | 5/1931 | Moore | 294/67.2 |
| 2,404,602 | 7/1946 | Stofflet | 294/67.5 X |
| 2,598,730 | 6/1952 | Thompson et al. | 294/67.2 X |
| 3,314,710 | 4/1967 | Edeburn | 294/68.26 |
| 3,332,716 | 7/1967 | Gridley | 294/67.2 |
| 3,998,488 | 12/1976 | Durgan | 294/67.21 |
| 4,722,106 | 2/1988 | Scegial et al. | 294/67.2 X |

FOREIGN PATENT DOCUMENTS

| | | | |
|---|---|---|---|
| 2512275 | 9/1976 | Fed. Rep. of Germany | 294/67.21 |
| 130236 | 3/1978 | German Democratic Rep. | 294/68.26 |
| 1199735 | 12/1985 | U.S.S.R. | 294/67.2 |
| 334604 | 9/1930 | United Kingdom | 294/68.26 |
| 483982 | 4/1938 | United Kingdom | 294/68.26 |
| 1227877 | 4/1971 | United Kingdom | 294/67.21 |

*Primary Examiner*—Johnny D. Cherry

*Attorney, Agent, or Firm*—Palmatier & Sjoquist

[57] ABSTRACT

A tray-like receptacle or container for catching falling debris from bridge deck demolitions is disclosed. The receptacle extends under a bridge deck and a support arm affixed to an end of the receptacle is disposed above the bridge deck. A crane suspends the receptacle with a cable attached to the support arm and another cable affixed to the receptacle is drawn in to tilt the receptacle so that crushed, collected concrete slides off an open end of the receptacle and into a dump truck. The support arm of the receptacle is disconnectable for storage and transportation purposes.

1 Claim, 2 Drawing Sheets

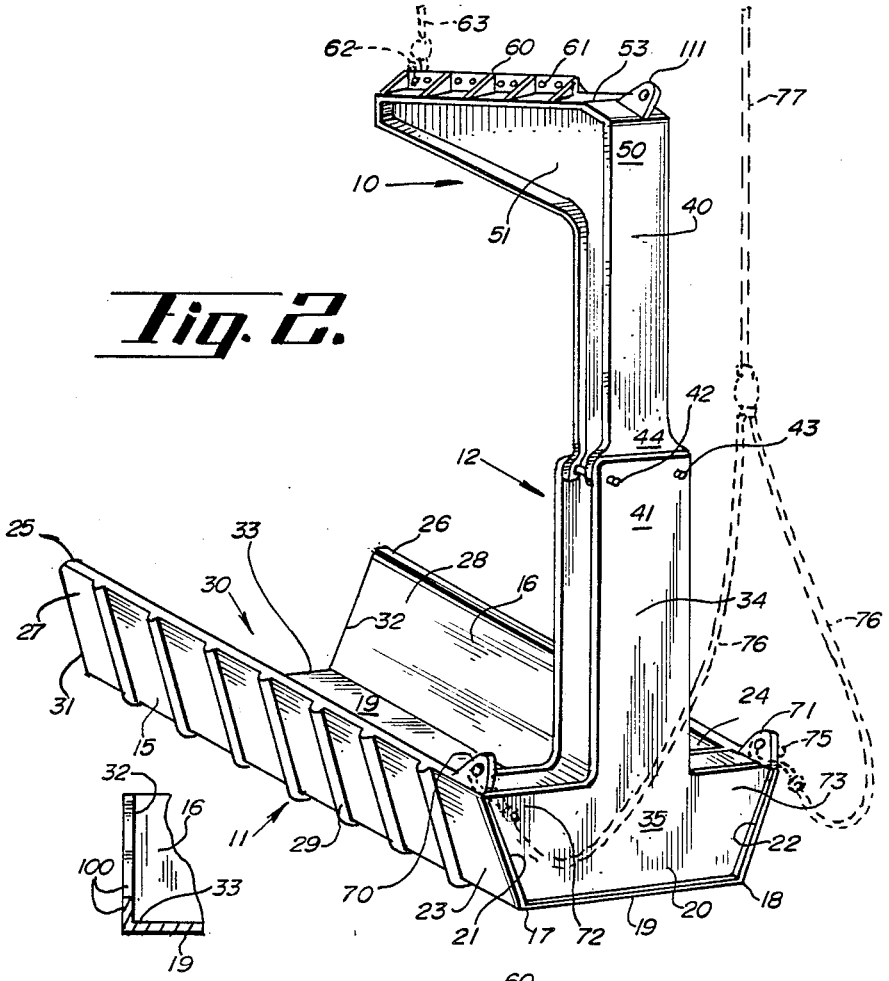
Fig. 2.
Fig. 4.
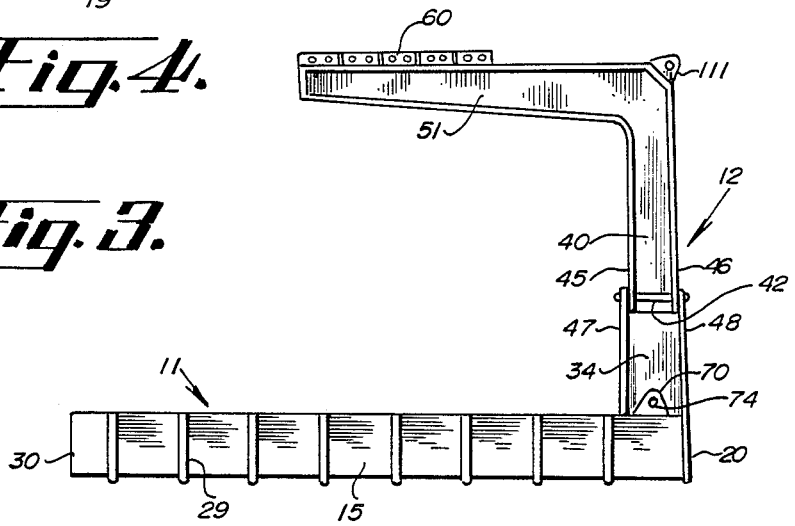
Fig. 3.

BEST AVAILABLE COPY

CATCH BASIN FOR BRIDGE DECK DEMOLITION

BACKGROUND OF THE INVENTION

The present invention relates to attachments for cranes and hydraulic excavators and more particularly to catch basin attachments for bridge deck demolition.

More than 200,000 bridges with spans of over twenty feet are in need of bridge deck repair in the United States. The bridges require bridge deck removal or demolition to meet standards set by state and federal agencies.

In bridge deck removal, it is typical to utilize hydraulic hammers, drop balls, or saws to fracture and demolish a bridge deck. Acetylene torches cut concrete reinforcing bars. More recently, contractors have utilized mobile concrete crushing attachments connected to the boom structures of hydraulic excavators to demolish bridge decks. The mobile concrete crushing attachments have shears with swinging jaws for crushing and breaking of concrete and reinforcing bars.

The debris created in bridge deck removal, such as crushed concrete and pieces of reinforcing bars, are conventionally allowed to fall through a bridge frame to the road, railroad tracks, or river passing under the bridge. Such practices create safety and environmental hazards, require undesirable clean up operations and may be prohibited by federal and state environmental regulations.

SUMMARY OF THE INVENTION

A feature of the present invention is a catch basin attachment to be suspended from a crane and inserted beneath bridge decks during demolition of a bridge deck to catch crushed concrete and pieces of reinforcing bars in such bridge deck removal and demolition operations.

Another feature of the present invention is the provision in such an attachment of an elongate catch basin suspended beneath a bridge deck and being operable and controllable from above the bridge deck.

Still another feature of the present invention is the provision in such an attachment of a support arm mounted on an end of the catch basin and extending partially thereover while allowing the basin to remain open and accessible to receive falling pieces of concrete and reinforcing bars and simultaneously permitting concrete crushing operations to be performed on the bridge deck above the basin.

Still another feature of the present invention is the provision in such an attachment of a winch carrying cable affixed to a support arm defining the center of balance of the catch basin attachment for suspending the attachment from a crane, and a winch dumping cable affixed to an end of the attachment for dumping contents of the catch basin into a dump truck.

An advantage of the present invention is that it eliminates the need for bulldozing fallen concrete into piles to be scooped up and dumped into dump trucks or, where falling concrete is undesirable, the need for building extensive platforms underneath bridges to catch falling concrete. With the present invention, concrete is collected immediately after it is broken from a bridge deck and transferred directly to a dump truck.

Another advantage of the present invention is that the catch basin may be suspended from a crane mounted at a distance from, or on a different level than, the demolition site. The crane suspending the basin may be located on a river bank adjacent the bridge being repaired or on a barge below the bridge, as well as being located on a truck on the bridge or on a road passing under the bridge.

BRIEF DESCRIPTION OF THE DRAWINGS

FIG. 2 is an enlarged front perspective view of the catch basin.

FIG. 3 is a detail side elevational view of the catch basin.

FIG. 4 is a detail section view of a portion of a modified form of container.

DETAILED DESCRIPTION OF THE PREFERRED EMBODIMENT

Figure 1:
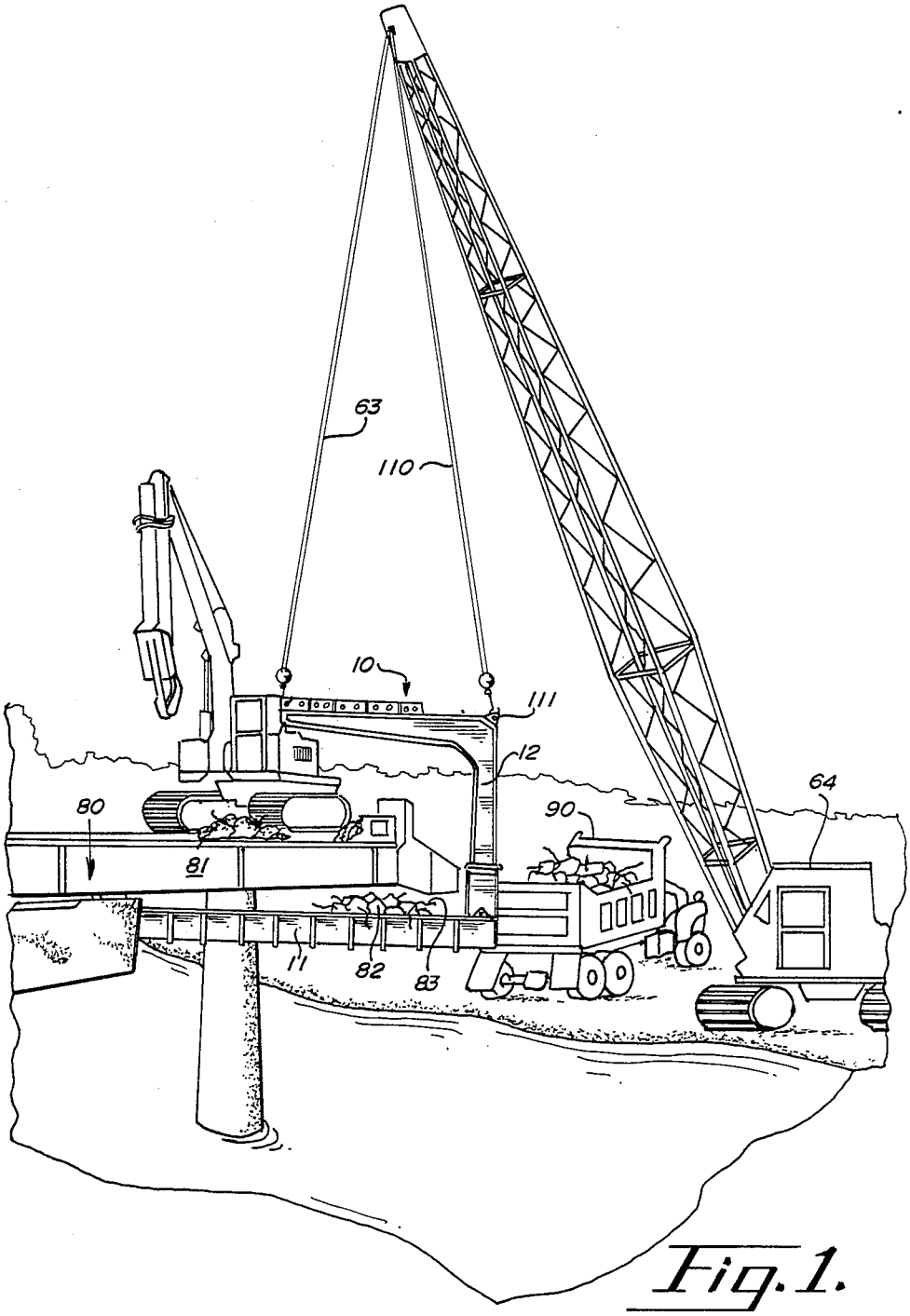
FIG. 1 is a perspective view showing the catch basin suspended from a crane and disposed under a bridge deck.

As shown in FIGS. 1-3, a catch basin or receptacle 10 has an elongate tray-like basin or container 11 and support means 12. The tray-like basin 11 is formed from a rigid hardened steel plate. The support means 12 is also formed from a hardened steel.

The tray-like basin 11 has a pair of elongate oblique sidewalls 15, 16 which extend outwardly and upwardly from a pair of respective longitudinal edges 17, 18 of an elongate floor 19. A trapezoidal end wall 20 extends substantially vertically from one end of the floor 19 and has a pair of oblique edges 21,22 affixed, as by welding, to a pair of end portions 23, 24 of sidewalls 15, 16. The walls 15, 16 and 20 are also welded to the floor 19 so that the tray-like basin 11 is substantially integral and one piece.

A pair of longitudinal elongate substantially horizontal flanges 25, 26 extend outwardly from a pair of upper longitudinal edges 27, 28 of sidewalls 15, 16. The flanges 25, 26 may be formed as part of the sidewalls 15, 16 or welded thereto.

A plurality of lateral support ribs 29 extend laterally across and are affixed in and to the sidewalls 15, 16 and the floor 19.

An open end 30 of the tray-like basin 11 is formed by a pair of distal oblique lateral edges 31, 32 of respective sidewalls 15, 16 and by a distal substantially horizontal lateral edge 33 of the floor 19.

The support means 12 is mounted on the tray-like basin 11. The support means 12 comprises an inverted L-shaped rigid structure affixed to and extending upward from the end wall 20. Support 12 has a lower substantially upright support leg 34 affixed, such as by welding, to a top central portion 35 of the end wall 20 so that the support leg 34 and end wall 20 are substantially integral and one piece.

An upper substantially upright support leg 40 is affixed to a top end 41 of the lower leg 34 by a pair of removable hinge pins 42, 43. A bottom end 44 of the upper leg includes an inner pair of laterally extending plates 45, 46 which fit between an outer pair of laterally extending plates 47, 48 affixed to the top end 41 of the lower leg 34. Each of the plates 45, 46, 47 and 48 form a pair of pin receiving apertures. Each aperture is aligned with three of the other apertures and receives one of the removable hinge pins 42, 43 to connect the tray 11 to the support arm 12. The pins 42, 43 are removable so that the support means 12 is detachable for transportation and storage.

BEST AVAILABLE COPY

An upper end 50 of the upper leg 40 is integrally connected to a longitudinal substantially horizontally tapering support arm 51 which lies above and along the basin 11 and extends and tapers convergently from the upper end 50. The length of the support arm 51 is somewhat more than one-half the length of the basin 11.

An apertural longitudinal connecting bar 60 extends along and is affixed by welding to the upper side 53 of the support arm 51. The connecting bar 60 has a plurality of lateral holes 61 in which a removable connecting hook or ring 62 of a suspending cable 63 is inserted. The hook or ring 62 and cable 63 suspend the catch basin 10 from the boom of a truck crane 64 as shown in FIG. 1.

A pair of rigid ears 70, 71 are affixed to and extend upwardly from a pair of respective top end portions 72, 73 of the end wall 20. Each of the ears 70, 71 has a lateral hole 74 in which a connecting ring 75 is inserted. Each ring 75 is connected to a tilting cable segment 76 of a tilting cable 77. The cable 77 is connected to the truck crane 64 as shown in FIG. 1. Alternately, cable 77 may be connected to the top of arm 51 adjacent its connection to leg 40.

In operation, the support arm 51 and upper leg 40 are hinged to lower leg 34. The ring 62 is inserted in the appropriate hole 61 which defines the center of balance of the catch basin 10 so that suspending cable 63 of the crane 64 suspends the catch basin 10 in a substantially horizontal orientation. Each ring 75 is inserted in its respective hole 74 of each of the ears 70, 71 so that tilting cable 77 is connected to the catch basin 10.

After the cables 63 and 77 are connected to catch basin 10, the crane 64 lifts, carries and maneuvers basin 10 to a bridge 80 having a bridge deck 81. The crane 64 moves the basin 10 so that the basin 11 is disposed underneath, and the support arm 51 is disposed above, the bridge deck 81. A construction worker may guide the basin 10 to its operating location by applying pressure to the support arm 51.

Subsequently, drop balls, hydraulic hammers, or mobile shears may be utilized to fracture or break down the bridge deck 81 into debris including pieces of concrete 82 and pieces of reinforcing bars 83. After being broken from the bridge deck 81, the crushed concrete 82 and cut reinforcing bars 83 fall into the tray-like basin 11. The catch basin 10 may be moved transversely or longitudinally with respect to the span of bridge to catch falling crushed concrete in unfilled areas of the tray-like basin 11 to maintain the center of balance of the catch basin 10, which may be upset by the addition of fallen concrete, or to prevent crushed concrete from spilling over walls 15, 16 and 20.

After the tray-like basin 11 is substantially full of crushed concrete or other debris, the crane 64 carries the catch basin 10 and accumulated concrete to a dump truck 90 whereupon the tilting cable 77 is drawn upwardly by a winch of the crane 64 to raise the closed end or end wall 20 with respect to the open end 30 of the catch basin 10. With the tilting of the catch basin 10, the crushed concrete 82 and broken pieces of reinforcing bar 83 slide through and off the open end 30 and into the dump truck 90. The effective length of cable 77 is thereafter increased to dispose the catch basin 10 in a horizontal orientation for further catching and collection operations.

In an alternate embodiment of the invention, as illustrated in FIG. 4, a retaining lip 100 may be affixed to, or formed as part of, the edges 31, 32 and 33 of the sidewalls 15, 16 and floor 19. The lip 100 may be disposed at right angles to its adjacent sidewall 15, 16 or floor 19 or may angle slightly outwardly therefrom. The lip 100 may assist in retaining crushed concrete in the tray-like basin 11 in catching operations but allow crushed concrete and pieces of reinforcing bars to slide out of the tray-like basin 11 in dumping operations.

In another alternate embodiment, a tilting cable 110 is affixed to an upper ear 111 of the upper end 50 of the upper leg 40. The tilting cable 110 assists the suspending cable 63 in supporting the catch basin 10 during catching and collecting of crushed concrete and is drawn in by a winch in the crane 64 to raise the end or end wall 20 with respect to the open end 30 and tilt the catch basin 10 in dumping operations.

What is claimed is:

1. An attachment for collecting broken pieces of concrete and the like for connection to a winch system of a mobile machine such as a crane and utilized in an operation such as a bridge deck demolition, comprising a tray-like container for collecting falling debris such as crushed concrete and broken reinforcing bars and having a closed end and an open end, the tray-like container having an elongate portion for extending transversely across the span of a structure such as a bridge, the tray-like container including a lateral rib for bracing the elongate portion, a support means for supporting the tray-like container and having an upright leg and a support arm, the upright leg mounted on the closed end of the tray-like container and being hinged so that the support means may be compacted for transportation and storage, the support arm affixed to an upper portion of the upright leg and extending inwardly over the tray-like container, the length of the support arm being approximately one-half the length of the tray-like container, a suspending cable connected to an inner portion of the support arm for suspending the tray-like container below a structure such as a bridge deck for the collection of falling debris, the inner portion of the support arm defining a center of balance of the support means and tray-like container, and a tilting cable connected to the closed end of the tray-like container, the tilting cable raising the closed end relative to the open end of the tray-like container so that the container is tilted and debris collected therein slides off the open end and into a vehicle such as a dump truck.

* * * * *